US005761773A

United States Patent [19]

Nauthe et al.

[11] Patent Number: 5,761,773

[45] Date of Patent: Jun. 9, 1998

[54] TEXTILE MACHINE FLEECE FUNNEL

[75] Inventors: Alfred Nauthe, Östliche Römerstrasse; Wolfgang Göhler, Jurastrasse, both of Germany

[73] Assignee: Rieter Ingolstadt Spinnereimaschinenbau AG, Ingolstadt, Germany

[21] Appl. No.: 840,374

[22] Filed: Apr. 29, 1997

[30] Foreign Application Priority Data

May 9, 1996 [DE] Germany ..... 196 18 642.0

[51] Int. Cl.[6] ..... D01H 5/72; D01H 13/04

[52] U.S. Cl. ..... 19/288; 19/150; 19/157

[58] Field of Search ..... 19/0.23, 236, 288, 19/291, 292, 150, 157

[56] References Cited

U.S. PATENT DOCUMENTS

| | | | |
|---|---|---|---|
| 614,819 | 11/1898 | Albasini . | |
| 2,996,873 | 8/1961 | Armstrong . | |
| 4,372,010 | 2/1983 | Gauvain . | |
| 4,575,903 | 3/1986 | Gauvain . | |
| 4,763,387 | 8/1988 | Bothner . | |
| 4,922,580 | 5/1990 | Bothner et al. . | |
| 4,939,894 | 7/1990 | Wolf . | |
| 4,949,431 | 8/1990 | Gasser . | |
| 5,016,322 | 5/1991 | Erni et al. . | |
| 5,412,846 | 5/1995 | Hauner . | |
| 5,666,698 | 9/1997 | Nauthe et al. | 19/157 |
| 5,680,678 | 10/1997 | Nauthe et al. | 19/157 |
| 5,689,856 | 11/1997 | Nauthe et al. | 19/157 |

FOREIGN PATENT DOCUMENTS

| | | |
|---|---|---|
| 801254 | 11/1950 | Germany . |
| 2623400 | 3/1977 | Germany . |
| 3612133C2 | 10/1987 | Germany . |
| 290679 | 6/1991 | Germany . |
| 406508 | 3/1934 | United Kingdom . |
| 632266 | 11/1949 | United Kingdom . |
| 786528 | 11/1957 | United Kingdom . |
| 2132240 | 7/1984 | United Kingdom . |

*Primary Examiner*—Michael A. Neas
*Attorney, Agent, or Firm*—Dority & Manning

[57] ABSTRACT

A fleece funnel is provided for use in textile drafting equipment to receive a fiber fleece conveyed by a pair of delivery rollers. The fleece funnel includes a long side disposed adjacent to the delivery rollers. A funnel area is defined in the long side for receiving the fiber fleece. The funnel area defines a planar guiding surface in a planar substantially concave impact surface. A funnel opening is defined in the impact surface and a funnel channel is in communication with the funnel opening. A ramp surface is defined on the long side outside of the funnel area. The ramp surface meets the impact surface and defines a common contour line with the impact surface so that air forced out of the fiber fleece balloon formed as the fiber fleece is conveyed into the funnel opening is drawn away from the funnel area towards the ramp surface unimpeded by planar components of the fleece funnel.

14 Claims, 5 Drawing Sheets

TEXTILE MACHINE FLEECE FUNNEL

BACKGROUND OF THE INVENTION

The present invention relates to a fleece funnel downstream of and at a distance from the output rollers of a set of drafting rollers, where one long side of a funnel area is constituted by a guiding surface, said guiding surface delimiting an impact surface, said impact surface being concave, with a funnel opening with funnel channel being located at the lowest point of the concavity, and with a ramp surface outside the funnel area.

Although the fleece funnel is also called a fleece nozzle in practice, only a fleece funnel shall be referred to hereinafter for the sake of uniformity.

The delivery speed of the drafted fiber sliver, such as it is delivered at the output of the drafting equipment by a pair of output rollers, is a criterium for the economic soundness of a draw frame.

In the technical development of the draw frame, the increase of delivery speed has been a major requirement. Below are some basic remarks concerning this:

As a rule, several fiber slivers which are united into one fiber sliver are presented to the drafting rollers of the draw frame. The combined fiber sliver is drafted in the drafting rollers. The pair of delivery rollers is the pair of output rollers of the drafting equipment and delivers a spread-out fiber sliver. The spread-out fiber sliver is called a fiber fleece. This fiber fleece is conveyed at delivery speed into the fleece funnel. The fiber fleece is imparted its delivery speed by the circumferential speed of the pair of delivery rollers. The fleece funnel must collect this fiber fleece, must roll it up, remove the air at the same time from the fiber fleece and deflect it into the funnel outlet, introducing it into same. With the introduction of the fiber fleece into the funnel outlet, a compressed fiber fleece is again created. Different designs are found in past developments of the fleece funnel.

A solution for a fleece funnel according to DE-OS 26-23-400 from 1976 shows a design such as it was used successfully at delivery speeds of approximately 350 meters/minute. From today's point of view, this is a slow delivery speed with other technological requirements. At this slow delivery speed, a well-known folding of the fleece across its width still takes place (a wedge-like folding as in an accordion).

As the delivery speed increased to around 950 meters/minute, the fleece funnel was given a different configuration. Such a configuration is shown in EP 593 884. This new, different form resulted from a different behavior of the fiber fleece as it impacts the fleece funnel, due to the higher delivery speed. The fiber fleece is no longer folded but becomes similar to a balloon being rolled up. At the previous delivery speed of up to 950 m/min, no difficulties were encountered with the known fleece funnel because the rolling-up process could be carried out reliably with the existing form of the fleece funnel and the optimal positioning of the pair of delivery rollers and of the fleece funnel. In practice, an arrangement emerged such as is still considered advantageous today at delivery speeds up to 950 m/min. Such an arrangement is also used in the RSB 951 draw frame of Rieter Ingolstadt Spinnereimaschinenbau AG.

The present development of the fleece funnel is due to the additional requirement for the automation of the introduction of a sliver end into the funnel outlet of the fleece funnel, up to the sliver funnel. For this reason, changes were made recently in the fleece funnel. DE-PS 36 12 133 shows a funnel-shaped inlet corresponding to a fleece funnel.

The document contains no statements concerning a fleece funnel, but in the automatic introduction of a sliver end it refers to the problem of air back-up in the sliver funnel (see column 1, 53rd to 62nd line). In order to remove the air carried by the fiber sliver on its way from the fleece funnel to and into the sliver funnel, the cross-section of the sliver funnel must be enlarged briefly in that area. This is necessary for the automatic introduction of the fiber fleece up to the sliver funnel. It is furthermore a disadvantage that the calender disks must be opened for the automatic introduction of the sliver end in order to manage the large air mass, i.e. to avoid air back-up which has a detrimental influence on the movement of the fiber sliver.

The problem of air mass in the automatic introduction of the sliver end into the fleece funnel, through the sliver funnel, and into the nip of the calender disks has been solved by the technical solution according to the European application 95114975.6. Therein, the fleece funnel was given a considerably greater role than the known fleece funnels. The result was a modified form of the fleece funnel. These modifications of the fleece funnel are described in detail in the above-mentioned, not yet published European application 95114975.6.

When attempting to increase the present high delivery speed of 950 m/min significantly to around 1200 m/min and more, it appears that the fleece funnel, in addition to other operating elements of the draw frame, plays an essential role in achieving the desired delivery speed. The fleece funnel must be able in this case to roll up the fiber fleece reliably and without affecting the quality at the considerably faster delivery speeds of the fiber fleece conveyed by the delivery rollers and must be able to move it on in the form of a fiber sliver. In this connection the automatic introduction of a spread-out fiber sliver (called a fiber fleece) beginning at the fleece funnel, must also be ensured.

The fleece funnels mentioned in the state of the art are not ensuring the desired success at delivery speeds of 1200 m/min and more. This also applies to the solution of the unpublished European application 95114975.6. The fiber fleece is either backed up, or the quality of the fiber sliver is adversely affected.

No information was disclosed in the state of the art on the configuration of a fiber funnel which would be necessary at delivery speeds of 1200 m/min and more, while preserving its functions for the automatic threading of a fiber fleece.

Further considerations were therefore concentrated on the fiber funnel described in the as yet unpublished European application 95114975.6 and concerning the placement of the fiber funnel across from the output roller pair (constituted by the delivery roller and a deflection roller). In operating such a fleece funnel at a fiber fleece delivery speed above 950 m/min, it has been shown that a considerably greater mass of fiber fleece is conveyed within the same time unit than at lower delivery speeds. Thus much more air caught in the fiber fleece is also conveyed.

The fiber fleece impacts the impact surface of the fiber funnel. A person schooled in the art knows that the fiber fleece forms a balloon as it impacts the impact surface because of the high delivery speed. The balloon rolls itself up and is conveyed into the outlet of the fleece funnel. When the delivery speed is increased to more than approximately 950 m/min, the balloon becomes larger. This may result in a change of the balloon configuration and may eventually impair its stability.

Another difficulty arises because of the greater circumferential speed of the pair of output rollers. This produces a stronger air flow in the fixed gaps between the fleece funnel and the pair of output rollers. This concerns the gap between lower drafting delivery roller and ramp surface of the fleece funnel. This stronger air flow has a detrimental effect. It affects the position of the balloon. Part of the balloon can be steered into the gap between fleece funnel and deflection roller. Damage to the balloon or backing up of the fleece is possible.

OBJECTS AND SUMMARY OF THE INVENTION

It is a principal object of the present invention to create a fleece funnel allowing for substantially higher delivery speeds than 950 m/min, without affecting the quality of the fiber sliver and without disturbing the movement of the fiber fleece, making also possible the additional function of automatic insertion of the fiber sliver end.

The fleece funnel according to the invention has the advantage that the fiber funnel operates without affecting the quality of the fiber sliver at delivery speeds of 1200 m/min and more. It also functions without interfering with the conveying of the fiber sliver. The form of the balloon is not disturbed with the fiber funnel according to the invention and the air can be removed more efficiently. An additional advantage is an improved cleaning effect of the fiber fleece.

The guiding surface and impact surface of the fiber funnel form a right angle with each other. The longitudinal axis of the funnel channel is in an imagined plane perpendicular to the impact surface and parallel to the guiding surface. The fiber fleece, which is also in a plane, makes contact with the impact surface. Between the imagined plane of the fiber fleece and the imagined surface of the longitudinal axis an angle is formed. This angle is called the impact angle $\alpha$. It has been found that the impact angle $\alpha$ has a value which is advantageously comprised between 15° and 19°. Ensuring this impact angle $\alpha$ optimizes trouble-free rolling up of the fiber fleece.

Another embodiment of the invention is achieved in which the distance D1 between the imagined plane of the longitudinal axis of the funnel channel and the guiding surface has a value within the range of 10 mm and 14 mm. This makes it possible for the balloon to take on an optimal form.

Another design consists in forming the impact surface from surface segments. A surface segment of the impact surface is located on either side of the funnel outlet, whereby its contour is substantially linear. The funnel outlet is located in this surface segment. The surface segments on either side of this surface segment are domed and constitute a tangential connection.

With the surface segment of a linear contour, the presentation of a wide fiber fleece end at the fleece funnel is possible, so that this end can be introduced automatically into the funnel outlet. With the surface segment of the linear contour, the convexity radius of the adjacent segments necessarily becomes smaller if the original width of the fleece funnel is to be maintained. This makes possible an offset grasping of the end of the fiber fleece. The portion of the fiber fleece lying on the linear surface segment is seized earlier by the suction air stream than that portion of the adjacent, convex surface segments. It is not necessary to shorten the width of the end of the fiber fleece for automatic introduction.

The new contour of the impact surface is an advantageous design and also improves the effect of the rolling up of the fiber fleece in that the centering force for the fiber fleece (mainly for the edges of the fiber fleece) has been strengthened.

Another advantageous design consists in reducing the guiding surface delimiting the funnel area in the area of the linear surface segment of the impact surface to a lower height than the original height of the guiding surface. The possibility also exists of reducing the height preferably in a central area of the guiding surface. This central area is approximately equal to the width of the fiber fleece. This creates a recess at the upper edge or a lowering of the upper edge of the guiding surface. The length of this recess is approximately equal to the width of the fiber fleece.

Furthermore the distance between the upper edge Ho of the guiding surface, i.e. the upper edge which was not lowered to a reduced height, and the upper roller (e.g. in form of a deflection roller) of the drafting equipment is basically from 0.5 to 6.5 mm. As a result, the edge fibers standing out from the fiber fleece are incorporated more efficiently into the fiber fleece.

However there also exists the possibility of omitting the recess at the upper edge of the guiding surface. This makes for a less advantageous embodiment. In that case the upper edge of the guiding surface should also be at a distance from the upper roller that is basically 0.5 to 6.5 mm.

An example of an embodiment of the invention is shown in the drawing and is described in further detail below.

DETAILED DESCRIPTION OF THE PREFERRED EMBODIMENTS

Figure 1:
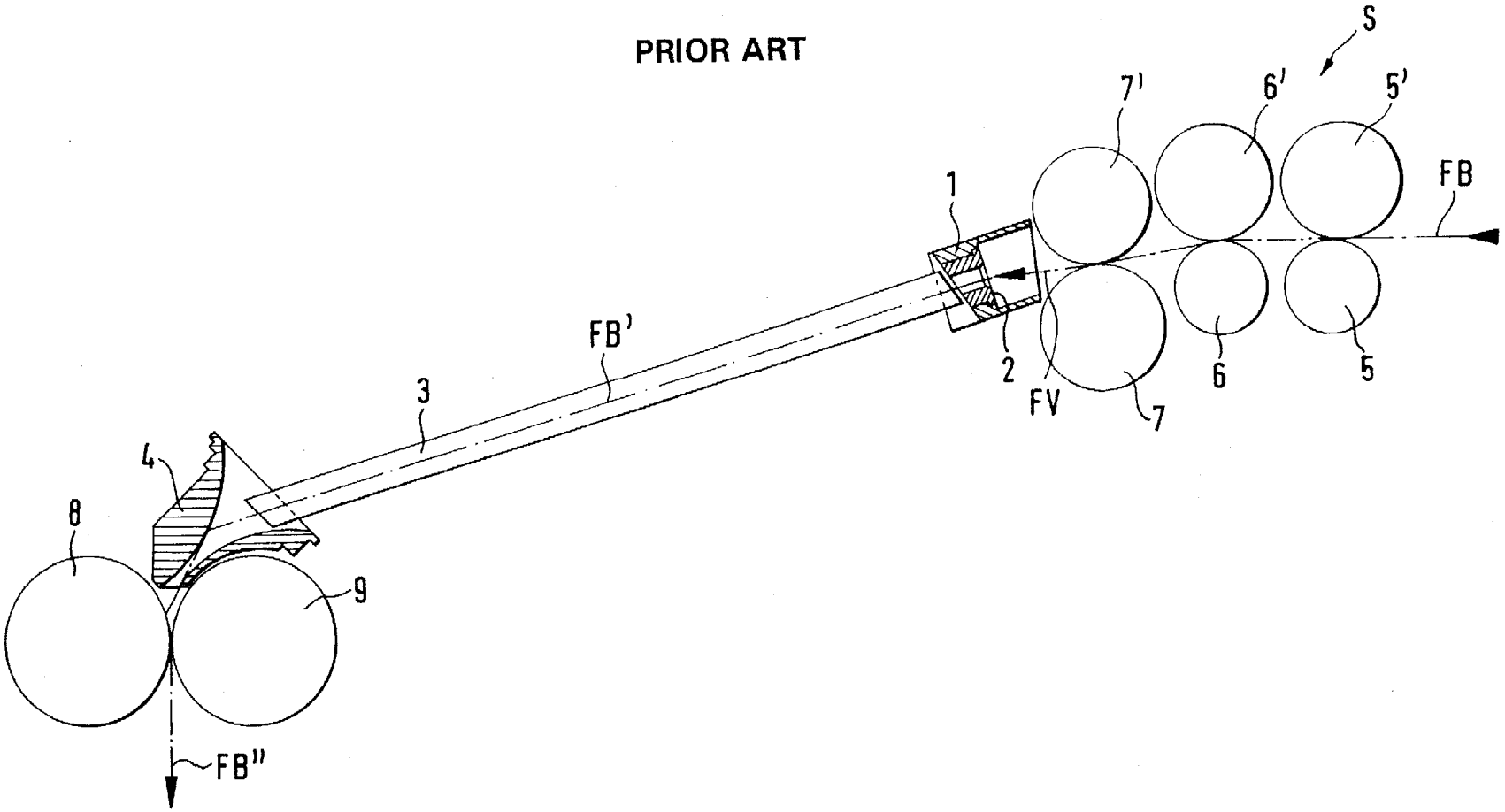
FIG. 1 PRIOR ART
FIG. 1 shows a fleece funnel according to the state of the art.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a further embodiment. It is intended that the present invention cover such modifications and variations.

FIG. 1 shows the arrangement of a fleece funnel (1), such as is used for example on the draw frame model RSB 951 of Rieter Ingolstadt Spinnereimaschinenbau AG. Based on the direction of movement of the fiber sliver FB, the fleece funnel (1) is located after the drafting equipment S. A 3-over-3 drafting equipment is shown. The pair of input rollers consists of rollers 5, 5'. The central pair of rollers is constituted by the rollers 6, 6' and the pair of output rollers is constituted by the delivery rollers 7, 7'.

The fiber sliver spread out after the pair of delivery rollers is conveyed into the fleece funnel in form of fiber fleece FV. The fleece funnel (1) is provided with a nozzle insert 2. Following the fleece funnel (1), a sliver guiding pipe 3 is installed which lets out into a sliver funnel 4. The sliver funnel 4 compresses the fiber sliver FB' and deflects it into the nip of the pair of calender rollers 8, 9. The calender rollers 8, 9 convey the fiber sliver FB" into a depositing device of the draw frame. This depositing device is not shown. The fiber fleece FV is securely seized by the fleece funnel (1) shown in FIG. 1, is folded, and formed into a skein fiber sliver FB'. The fleece funnel used on the RSB 951 reliably carries out this function for fiber fleece FV delivery speeds of 950 m/min. This delivery speed is imparted to the fiber fleece FV by the output rollers, constituted by the pair of delivery rollers 7, 7'.

Figure 2:
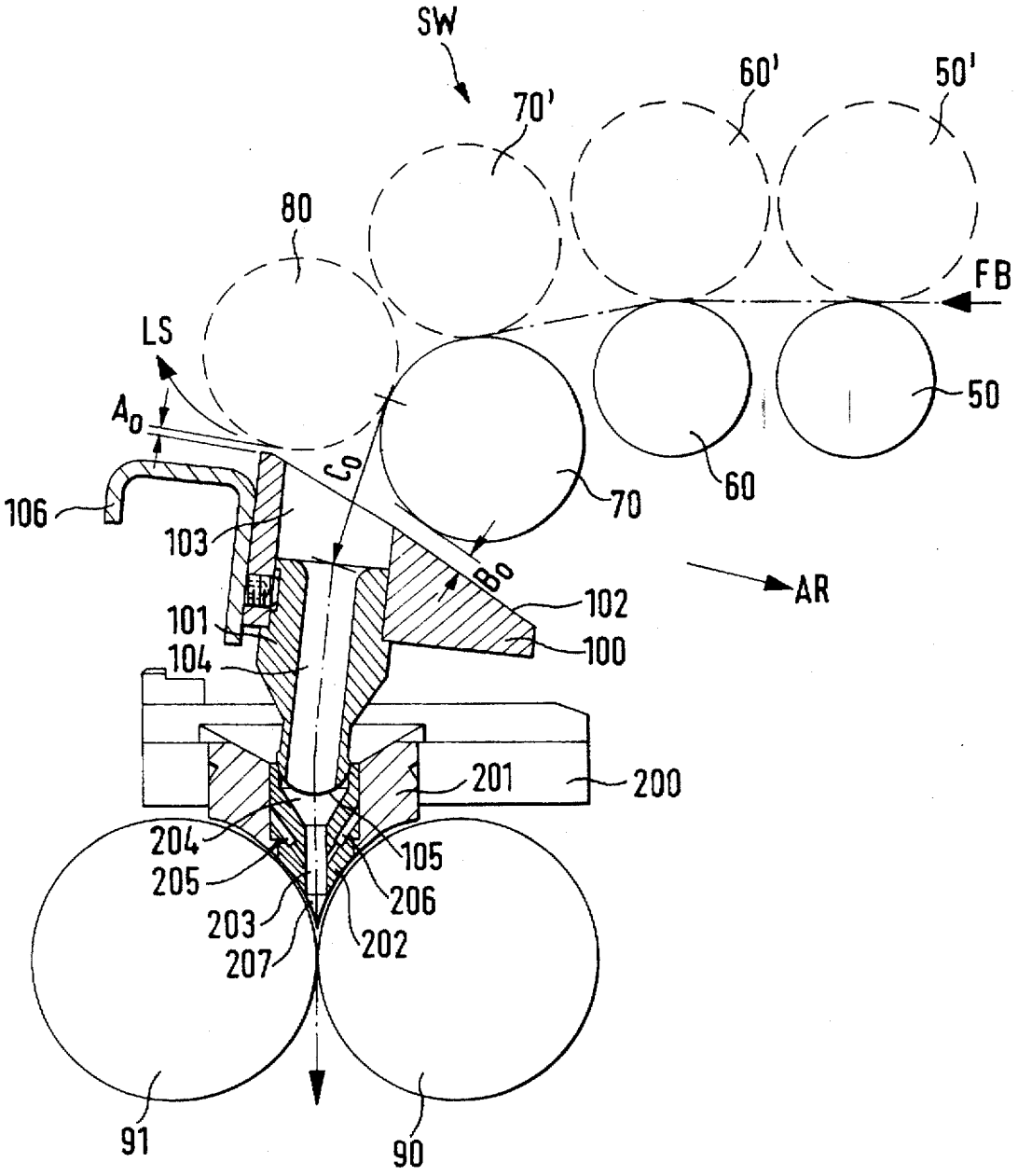
PRIOR ART FIG. 2
FIG. 2 shows a sliver guiding apparatus with fleece funnel according to the European application 95114975.6.

A further development is shown in FIG. 2. Here the arrangement of a fleece funnel 100 is shown as described in detail in the European application 95114975.6. This fleece funnel can also be used reliably at delivery speeds of up to 950 m/min and in addition makes an automatic insertion of the end of a fiber fleece possible. The following are details of its operation.

The fiber sliver FB is presented to the drafting equipment SW. The fiber sliver FB may be a single fiber sliver or a single, doubled fibers sliver. This fiber sliver FB is drawn in by the pair of input rollers 50, 50'. These are followed by the central pair of rollers 60, 60'. There follows the pair of delivery rollers delivery rollers 70, 70', whereby the delivery roller 70 and the deflection roller 80 constitute the pair of output rollers. The pair of output rollers may also be constituted by a delivery roller 70 and its upper roller 80, for instance.

FIG. 2 shows the fleece funnel in its operating position. The fleece funnel 100 is provided with a plug-in, attachable nozzle insert 101 with a funnel channel 104. The funnel channel 104 is provided at its outlet with an articulated surface 105. The nozzle insert 101 can be swivelled together with the fleece funnel 100 on the side of the conical segment 204 of a sliver funnel insert 202 by means of this articulated surface 105. The sliver funnel insert 202 is received by a sliver funnel seat 201. The sliver funnel seat 201 is inserted in a holder 200. The sliver funnel insert 202 is provided with a cylindrical channel 203. Injector bores 205, 206 which are connected to an external compressed-air system (not shown) let out in the cylindrical channel 203. Guiding prongs which adapt themselves to the radius of the calender disks 90, 91 and extend into proximity of the nip, as shown by a guiding prong 207, are located on either side of the outlet of the cylindrical channel 203. FIG. 2 furthermore shows that in its operating position of the fleece funnel 100, a narrow space exists between the fleece funnel 100 and the deflection roller 80, this being the distance $A_o$. During the operation of the drafting equipment and especially under the action of the deflection roller 80, an air current LS (in the direction shown by the arrow) is conveyed through this gap with distance $A_o$.

Below the lower rollers of the drafting equipment SW constituted by the input roller 50, the central roller 60 and the delivery roller 70, a suction air stream AR acts in the direction indicated by an arrow. The suction air stream AR is produced by a suction system (not shown) below the drafting equipment SW. An air current moving through the gap with distance $B_o$ is included in the suction air stream AR.

$C_o$ characterizes the distance between nip KL of the pair of output rollers and the funnel outlet.

Figure 3:
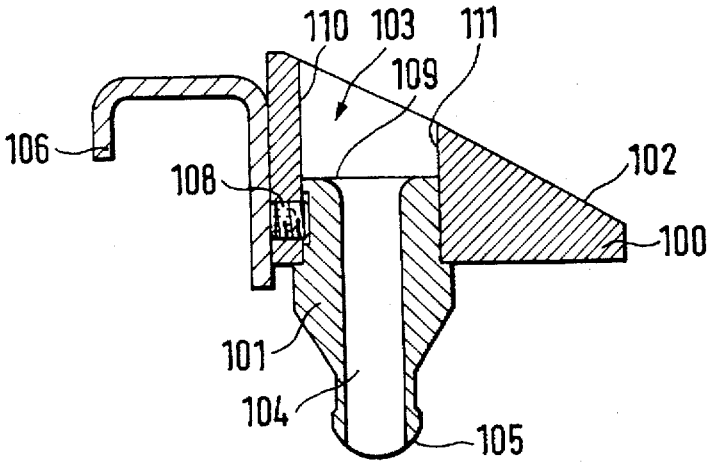
PRIOR ART FIG. 3
FIG. 3 shows the fleece funnel with details from FIG. 2.

FIG. 3 shows additional details concerning the fleece funnel 100 such as it is used in the European application 95114975.6. The fleece funnel 100 is constituted with an essentially rectangular opening edge of the fleece funnel. Each of the long sides of the funnel area 103 is formed by -a guiding surface 110 and a delimiting surface 111. Between them an impact surface 109 is located. The impact surface 109, following a radius, is inclined in a concave manner, whereby the funnel outlet is at the lowest point of the concavity. The funnel outlet is constituted by a nozzle insert 101 which can be inserted into the fleece funnel 100 and can be fixed by means of stopping device 108. On the impact surface the nozzle insert 101 constitutes the funnel outlet which is connected to a funnel channel 104. The funnel channel 104 constitutes an articulated surface 105 in proximity of its channel outlet. Outside the funnel area 103 a ramp surface 102 is provided and leads to the delimiting surface 111. The fleece funnel 100 is swivelled manually by means of the handle 106 which is also stopped by means of the stopping device 108.

Figure 4:
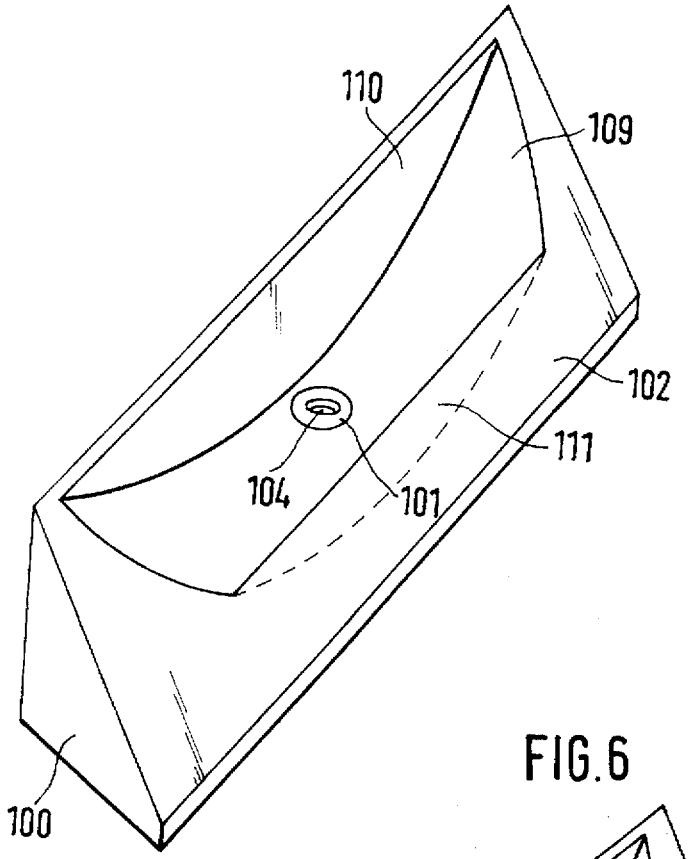
PRIOR ART FIG. 4
FIG. 4 is a three-dimensional representation of the fleece funnel according to the European application 95114975.6.

FIG. 4 shows the fleece funnel 100 without the handle 106 and without swivel bearing in a three-dimensional drawing. The reference numbers of FIG. 4 match those of FIG. 3.

The fiber fleece impacts the impact surface 109 at higher delivery speed and with greater force. The fleece is diverted from the impact surface 109 to the guiding surface 110. At the same time the fleece constitutes a balloon-like formation, called a balloon. When this balloon comes into contact with the guiding surface 110 the balloon is caused to roll up upon itself and is guided into the funnel channel 104. As the delivery speed increases beyond 950 m/min, the balloon grows in size. At the same time, the air current LS at the distance A increases in force as shown in FIG. 2. Because of the increased air current LS, the fleece balloon can be deflected into the space with the width $A_o$. This has a detrimental effect on the rolling up of the fiber fleece. In the worst case the fiber fleece is backed up and the delivery of the fiber fleece must be stopped.

Figure 5:
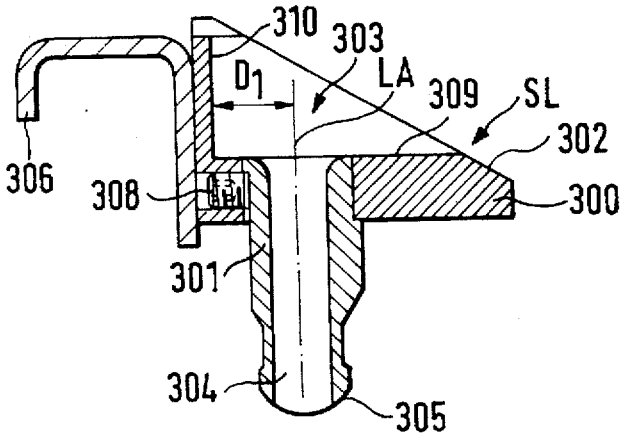
FIG. 5 shows a fleece funnel with characteristics according to the invention.
Figure 6:
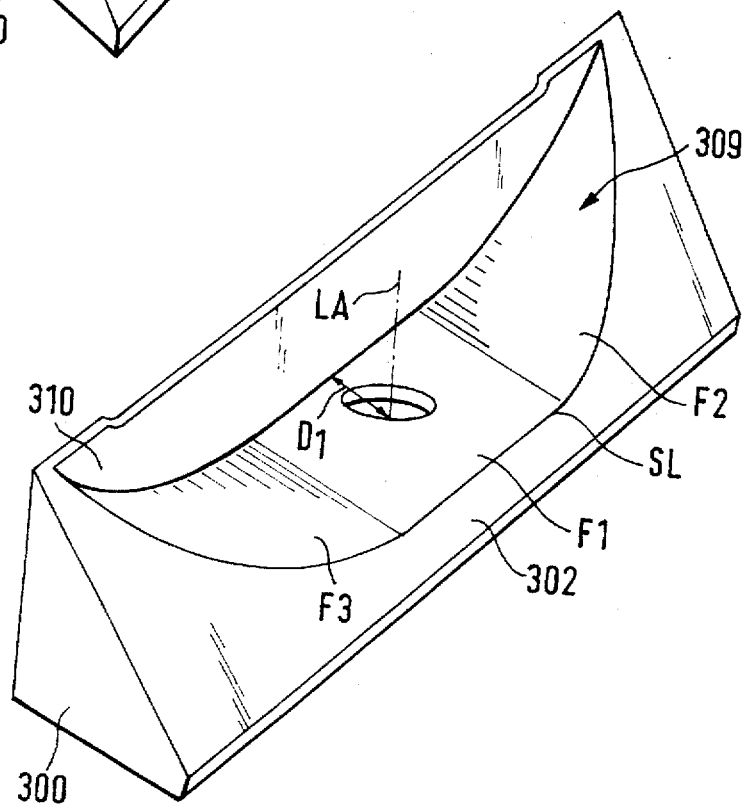
FIG. 6 is a three-dimensional representation of the fleece funnel according to the invention as in FIG. 5.

FIG. 5 shows a fleece funnel 300 with characteristics according to the invention. This embodiment is characterized in that the impact surface 309 is widened to such an extent in the direction of the ramp surface 302 that the contour of the impact surface forms a common intersection line SL with the contour of the ramp surface (FIGS. 5, 6). No delimiting surface 111 as in FIG. 3 is used in this case. A contour is formed by a contour line relative to a surface.

Surprisingly, this embodiment has the advantage that the air carried along with the fiber fleece can be removed much better. The air to be removed can be incorporated into the suction air stream AR (shown in FIG. 2) of the lower drafting equipment suction system without having to overcome any obstacles (originally the delimiting surface) and thereby without resistance. This results in an improved configuration of the balloon. Aspiration of the balloon against the space between the upper roller and the guiding surface is avoided. Another effect of this measure has been shown in an improved cleaning effect. The pollution (dust, foreign particles) developed during the impact of the fiber fleece and not again taken up by the fiber fleece as before, but are incorporated directly together with the air to be removed into the suction air stream and are removed.

The guiding surface 310 and the impact surface 309 of the fleece funnel form together a right angle. The longitudinal axis LA of the funnel channel 304 lies in a plane which is perpendicular to the impact surface and parallel to the guiding surface 310. This plane is not shown, but can be reconstructed in theory through FIG. 9. The fiber fleece FV which is also in a plane, impacts the impact surface 309. This plane is not shown in the drawing, but can also be reconstructed by using FIG. 9.

Figure 9:
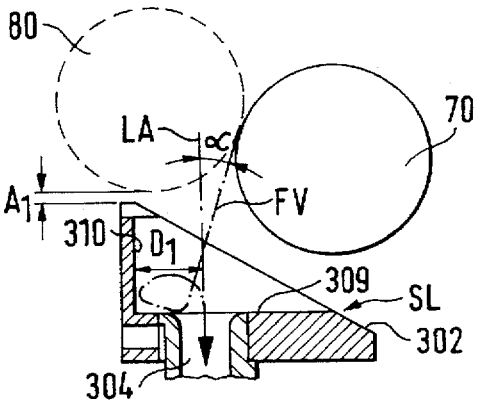
FIG. 9 shows the angle of impact at the fleece funnel.

Between the imagined plane of the fiber fleece FV and the imagined plane of the longitudinal axis LA an angle is formed which is called the impact angle α (see FIG. 9). It has been found that the impact angle α is advantageously comprised between 15° and 19°. Ensuring this impact angle α optimizes the trouble-free rolling up of the fiber fleece.

In another embodiment the distance $D_1$ between the imagined plane of the longitudinal axis LA of the funnel channel 304 and the guiding surface 310 lies between 10 mm and 14 mm. This enables the balloon to form in an optimal manner.

In another embodiment (FIG. 6) the impact surface 309 consists of surface segments (F1, F2, F3). A surface segment Fl of the impact surface 309 is formed which is located on either side of the funnel outlet and has an essentially linear contour. On either side of the surface segment Fl are the surface segments F2 and F3. The surface segments F2, F3 have a smaller radius than the radius of the impact surface 109 of FIG. 3 surface segment Fl. The new contour of the impact surface 309 makes an offset seizing of the end of the fiber fleece possible. The fiber fleece located in the surface segment Fl is seized from the funnel outlet with funnel channel 304 earlier by the suction air stream than the same fiber fleece located in the surface segments F2, F3. Thereby, a fiber fleece tip is formed and seized automatically. This facilitates the automatic introduction of an end of a fiber fleece. No portion reduced from the total width of the fiber fleece need be presented to the fleece funnel. The fiber fleece can be presented to the fleece funnel in its full width. This is an improvement. Surprisingly the centering force for the fiber fleece could be increased so that the rolling up effect of the yarn fleece could also be optimized at high speeds. For better understanding FIG. 6 shows several characteristics in a three-dimensional representation which were already explained through FIG. 5.

In another embodiment (FIGS. 8, 8*a*) the guiding surface 310 delimiting the funnel area 303 is reduced in height as compared with the impact surface to a height $H_1$ from the original height $H_o$ of the guiding surface. Such a reduction of the original height of the guiding surface is made at least in the area of the linear surface segment Fl of the impact surface 309.

Figure 8A:
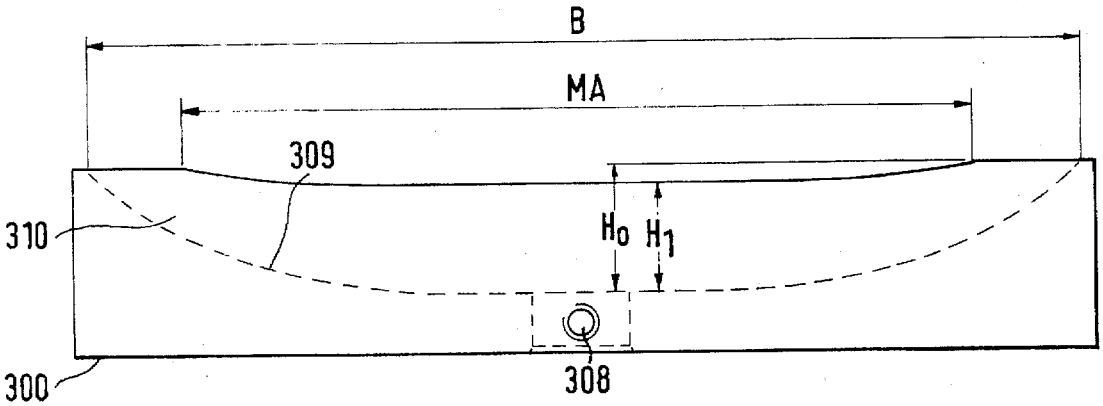
FIGS. 8 and 8*a* show a fleece funnel with partially reduced height of the guiding surface.
Figure 8:
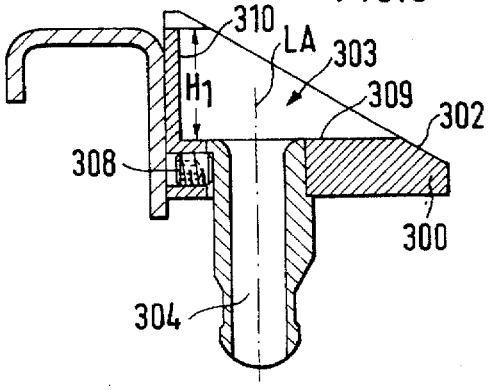

Another possibility consists in reducing the height of the guiding surface to a height $H_1$ in a central area MA of its width B (FIG. 8*a*). The central area MA has approximately the width of the presented fiber fleece. The height $H_1$ is reduced by at least 1 mm from the original height $H_o$.

Figure 7:
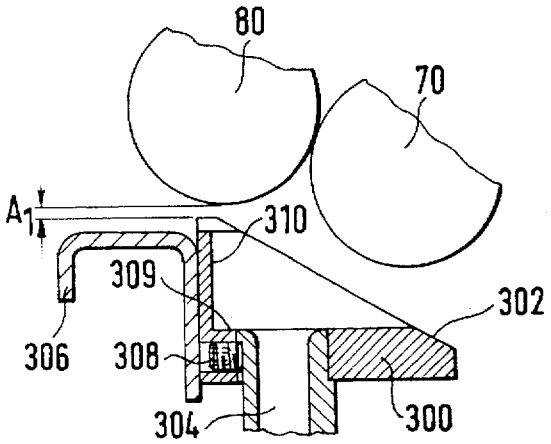
FIG. 7 is a representation of the distances between the fleece funnel according to the invention and the pair of output rollers.

In another modification, the upper edge of the guiding surface 309 in the area of the remaining original height $H_o$ is placed at a distance $A_1$ from the upper roller 80 (FIGS. 7 and 9), whereby the distance $A_1$ has a value from 0.5 mm to 6.5 mm. With this recess of the upper edge caused by height $H_1$ (according to FIG. 8*a*) an aimed air stream coming from the funnel area can be directed to behind the guiding surface, causing spread-out border fibers to be incorporated more efficiently into the fiber fleece.

The invention has the further advantage that the automatic introduction of a fiber fleece could be improved. The improvement reveals itself in that now the beginning of a fiber fleece can be presented to the fleece funnel in its entire width. It is no longer necessary to present a portion of the fiber fleece with reduced width to the fleece funnel.

It will be appreciated by those skilled in the art that various modifications and variations can be made in the present invention without departing from the scope and spirit of the invention. It is intended that the invention cover such modifications and variations as come within the scope of the appended claims and their equivalents.

We claim:

1. A fleece funnel for use in textile drafting equipment to receive a fiber fleece conveyed thereto by a pair of delivery rollers, said fleece funnel comprising:

a long side disposable adjacent to said delivery rollers, said long side defining a funnel area therein for receiving a fiber fleece from said delivery rollers;

said funnel area defined by a planar guiding surface and a generally concave impact surface, said guiding surface defining an angle with said impact surface;

a funnel opening defined in said impact surface with a funnel channel in communication with said funnel opening;

a ramp surface defined on said long side outside of said funnel area; and wherein said ramp surface meets said impact surface and defines a common contour line therewith so that air forced out of a fiber fleece balloon formed as a fiber fleece is conveyed into said funnel opening and said funnel channel is drawn away from said funnel area towards said ramp surface unimpeded by planar components of said fleece funnel.

2. The fleece funnel as in claim 1, wherein a distance of generally between 10 mm and 14 mm is defined between said guiding surface and a longitudinal axis through said funnel opening and funnel channel.

3. The fleece funnel as in claim 2, wherein said guiding surface comprises a generally flat planar element and forms an angle of generally 90 degrees with said impact surface.

4. The fleece funnel as in claim 1, wherein said impact surface comprises an essentially flat middle surface segment with said funnel opening defined therein, and essentially concave surface segments on either side of said middle surface segment.

5. The fleece funnel as in claim 1, wherein said guiding surface has a height that is reduced at least in an area adjacent said funnel opening in said impact surface.

6. The fleece funnel as in claim 4, wherein said guiding surface has a height that is reduced at least in an area adjacent said middle surface segment.

7. The fleece funnel as in claim 1, wherein said guiding surface has a width and a height, said height reduced in a central area of said width.

8. The fleece funnel as in claim 7, wherein said height is reduced generally by at least 1.0 mm in said central area of said width.

9. A textile drafting machine, comprising:

drafting equipment including at least a pair of output delivery rollers disposed to deliver a fiber fleece from said drafting equipment;

a fleece funnel disposed downstream from said delivery rollers for receiving said fiber fleece therefrom, said fleece funnel comprising a long side disposable adjacent to said delivery rollers, said long side defining a funnel area therein for receiving the fiber fleece from said delivery rollers;

said funnel area defined by a planar guiding surface and a substantially concave impact surface, said guiding surface defining an angle with said impact, surface;

a funnel opening defined in said impact surface with a funnel channel in communication with said funnel opening;

a ramp surface defined on said long side outside of said funnel area; and wherein said ramp area meets said impact surface and defines a common contour line therewith so that air forced out of a fiber fleece balloon formed as a fiber fleece is conveyed into said funnel opening and said funnel channel is drawn away from said funnel area towards said ramp surface unimpeded by planar components of said fleece funnel.

10. The textile drafting machine as in claim 9, wherein an impact angle of generally between 15 degrees and 19 degrees is defined between a plane of said fiber fleece impacting on said impact surface and a longitudinal axis through said funnel opening and said funnel channel.

11. The textile drafting machine as in claim 9, wherein said guiding surface comprises an upper edge defining a height for said guiding surface, said upper edge at a distance of generally between 0.5 mm and 6.5 mm from an upper roller of said delivery rollers.

12. The textile drafting machine as in claim 11, wherein said height of said guiding surface is reduced in a central area of said guiding surface.

13. The textile drafting machine as in claim 9, wherein said impact surface comprises an essentially flat middle surface segment with said funnel opening defined therein, and an essentially concave surface segment on either side of said middle surface segment.

14. The textile drafting machine as in claim 13, wherein said guiding surface has a height that is reduced at least in an area adjacent said middle surface segment.

* * * * *

UNITED STATES PATENT AND TRADEMARK OFFICE

CERTIFICATE OF CORRECTION

PATENT NO. : 5,761,773

DATED : JUNE 9, 1998

INVENTOR(S) : NAUTHE ET AL.

It is certified that error appears in the above-identified patent and that said Letters Patent is hereby corrected as shown below:

Column 6, line 33, delete "A" and substitute therefor --$A_o$--.

IN THE CLAIMS

Claim 9, column 9, line 8, delete "planar".

Signed and Sealed this

Fourth Day of January, 2000

*Attest:*

*Attesting Officer*

*Acting Commissioner of Patents and Trademarks*